US005586682A

United States Patent [19]

Yeh

[11] Patent Number: 5,586,682

[45] Date of Patent: Dec. 24, 1996

[54] HANDLE GRIP PIECE FOR USE IN GRIPPING A DRINKING MUG

[76] Inventor: Frank Yeh, 1019 N. Mayflower St., Anaheim, Calif. 92801

[21] Appl. No.: 547,108

[22] Filed: Oct. 23, 1995

[51] Int. Cl.[6] ..... B65D 25/28

[52] U.S. Cl. ..... 220/755; 220/759; 220/4.24

[58] Field of Search ..... 220/759, 755, 220/753, 4.21, 4.24, 703, 710.5; 215/396, 397; 16/114, DIG. 12

[56] References Cited

U.S. PATENT DOCUMENTS

| | | | |
|---|---|---|---|
| 775,662 | 11/1904 | Lyon | 220/759 |
| 1,730,820 | 10/1929 | Holden | 16/DIG. 12 |
| 2,146,415 | 2/1939 | Bradley | 220/753 |
| 2,398,436 | 4/1946 | Mason | 16/114 |
| 5,025,939 | 6/1991 | Bunn et al. | 220/4.21 |

FOREIGN PATENT DOCUMENTS

| | | | |
|---|---|---|---|
| 148159 | 7/1985 | European Pat. Off. | 220/759 |

*Primary Examiner*—Stephen J. Castellano
*Attorney, Agent, or Firm*—Raymond Sun

[57] ABSTRACT

A handle grip piece is provided for use with the handle of a mug. The handle grip piece has a first side piece including an inner edge and an arcuate outer surface facing the wall of the mug. The first side piece has an upper recess and a lower recess spaced-apart from the upper recess, and a plurality of protrusions extending from the inner edge. The handle grip piece also has a second side piece including an inner edge and an arcuate outer surface facing the wall of the mug. The second side piece has an upper recess and a lower recess spaced-apart from the upper recess, and a plurality of notches provided along the inner edge. The upper and lower recesses of the first and second side pieces are adapted to receive and connect portions of the handle. The protrusions of the first side piece are adapted to be engaged with the notches of the second side piece to connect the first side piece to the second side piece.

11 Claims, 3 Drawing Sheets

HANDLE GRIP PIECE FOR USE IN GRIPPING A DRINKING MUG

BACKGROUND OF THE INVENTION

1. Field of the Invention

The present invention relates to a removable handle grip piece for use in allowing the user to more easily grip the handle of a mug. The handle grip piece may be deployed at the handle of any mug, and also may be removed and deployed at the handle of another mug.

2. Description of the Related Art

The present invention is applicable to mugs and beverage containers alike, which shall hereinafter be collectively referred to as "mugs". These mugs are typically made of ceramic material because ceramic is easy to clean, does not carry any unpleasant odors, and is effective in maintaining the temperature of the liquid contained therein. However, ceramics are not the only materials that can be used, and other materials such as porcelain, glass, plastics and stoneware, for example, may also be used for making beverage containers and mugs according to the present invention.

The conventional mugs that are presently available today are typically provided with a curved handle. These curved handles are also provided in a standard shape and size. Unfortunately, these curved handles are not easy to grip. The most effective way of gripping such curved handles is to press the palm of the gripping hand against the outer surface of the curved handle at about the center portion of the curved handle, wrap the four fingers around the curved handle, and then press the thumb against the top of the curved handle. Since the conventional curved handle is made of a thin curved bar, the inside of the user's four fingers do not actually grip or contact the inside surface of the curved handle, so that the user's grip of the handle is not a firm and secure one. A shaky grip can be troublesome if the user is carrying a full mug containing hot fluids because of the potential for spillage.

In response to these problems, an attempt has been made to improve the user's grip of a curved handle on a conventional mug. FIG. 1 illustrates a prior attempt in which a mug 10 is provided with a conventional curved handle 12. The curved handle 12 has a central curved portion 14, a top curved portion 16 integrally connected to the wall 24 of the mug 10, and a bottom curved portion 18 also integrally connected to the wall 24 of the mug 10. A gripping bar 20 is provided integrally with the curved handle 12, with an upper end of the gripping bar 20 integrally connected between the central portion 14 and the top portion 16, and a lower end of the gripping bar 20 integrally connected between the central portion 14 and the bottom portion 18. The gripping bar 20 is arcuate such that its central portion 22 is closest to the wall 24 of the mug 10 and furthest from the central portion 14 of the curved handle 12, while its upper and lower ends are furthest from the wall 24 of the mug 10. The gripping bar 20 further comprises an abutment 26 extending from the upper outer surface of the curved handle 12 and acting as a thumb rest, and a similar abutment 28 extending from the lower outer surface of the curved handle 12. Three ridges 30 define concave regions 32 for receiving the inside surface of the user's fingers.

In use, the user would rest the palm of the gripping hand against the outer surface of the central portion 14 of the curved handle 12. The user then wraps the fingers around the gripping bar 20 so that the fingers rest against the concave regions 32. The thumb is pressed against the upper abutment 26. The grip is improved because the four fingers can now firmly grip the gripping bar 20 to achieve a firmer and more secure grip, as opposed to the conventional curved handle in which the four fingers do not have a stable object, such as the gripping bar 20, to place a firm grip on.

While the gripping bar 20 of FIG. 1 achieves the result of improving a user's grip, it suffers from the drawback that it is integral and must therefore be provided with the mug. Therefore, the consumer must buy the new mug with the gripping bar to obtain the improved grip. However, there presently exists many conventional mugs provided with conventional or standard curved handles, and it is not feasible for a consumer to completely replace all these conventional mugs with the new mugs that incorporate the gripping bar 20.

Thus, there remains a need for a simple and removable handle grip piece which is effective in improving a user's grip of the handle, and which may be adapted for use with any handle of any mug, including the conventional curved handle of a conventional mug, to offer the consumer with the flexibility of using such a handle grip piece with any mug.

SUMMARY OF THE INVENTION

The objects of the present invention may be achieved by providing a handle grip piece for use with a handle of a mug. The handle grip piece has first and second side pieces, each having an inner edge and an arcuate outer surface facing the wall of the mug. Each of the first and second side pieces further includes structure for connecting the respective side piece to a portion of the handle. Mechanisms are provided along the inner edges of the first and second side pieces for connecting the first side piece to the second side piece.

In a first embodiment of the handle grip piece according to the present invention, the mechanisms for connecting the first side piece to the second side piece include a plurality of protrusions extending from the inner edge of the first side piece and a plurality of notches provided along the inner edge of the second side piece. The protrusions of the first side piece are adapted to be engaged with the notches of the second side piece to connect the first side piece to the second side piece. In a second embodiment of the handle grip piece according to the present invention, opposing velcro pads may be used to connect the first side piece to the second side piece.

In a first embodiment of the handle grip piece according to the present invention, the structure for connecting the first side piece to a portion of the handle includes an upper curved recess and a lower curved recess, and the structure for connecting the second side piece to a portion of the handle also includes an upper curved recess and a lower curved recess. The upper curved recesses of the first and second side pieces are adapted to receive and connect the handle at a location between the central portion and the top portion of the handle, and the lower curved recesses of the first and second side pieces are adapted to receive and connect the handle at a location between the central portion and the bottom portion of the handle.

The handle grip piece according to the present invention further comprises a plurality of bumps positioned on the arcuate outer surface of the first and second side pieces for enhancing the grip of the user's fingers. Each of the first and second side pieces also includes an upper extension that can be used as a thumb rest.

In a first embodiment of the handle grip piece according to the present invention, the first and second side pieces are a thin strip of material. In a second embodiment of the handle grip piece according to the present invention, the first and second side pieces each has an inner arcuate surface adapted to engage the curved inner surface of the handle.

Thus, the handle grip pieces according to the present invention are simple and effective devices for improving the user's grip of the handle of a mug. The handle grip pieces are easy to use, and can be deployed at the handle of any mug and removed for deployment at another mug. Because of their simple design and construction, the handle grip pieces are also easy and inexpensive to manufacture, so that they can be provided at low cost to the public.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Although the handle grip pieces described hereinbelow are described and illustrated as being adapted for use with conventional or standard handles, the present invention is not so limited and may also include handle grip pieces provided in certain specific shapes and sizes for specific use with mugs having handles with special sizes or shapes. All such handle grip pieces are likewise removable and easy to deploy.

Figure 6:
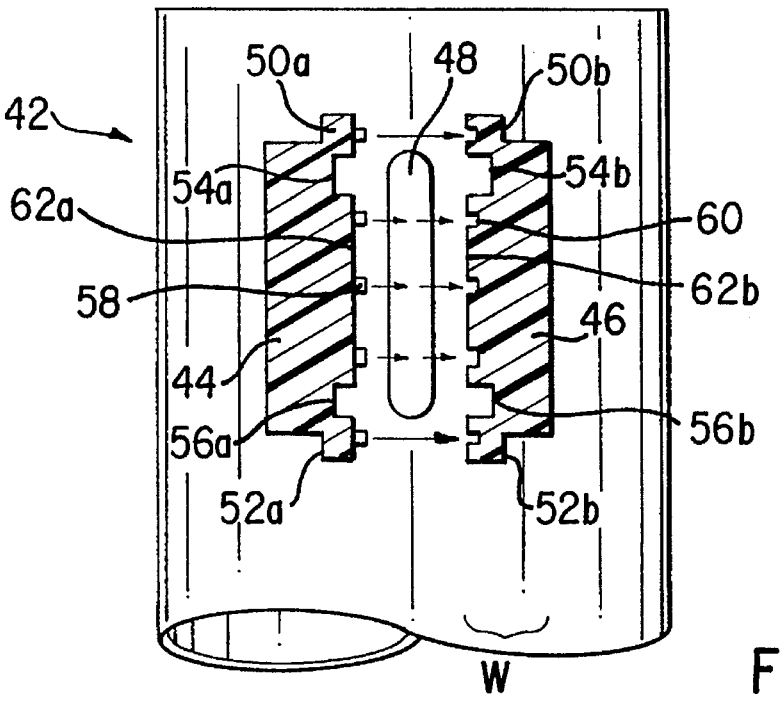
FIG. 6 is an exploded sectional side view of a conventional mug illustrating how the handle grip piece of FIG. 2 is deployed at the handle of the mug.
Figure 3:
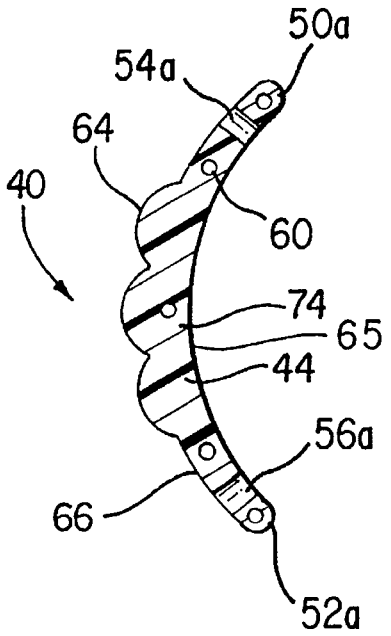
FIG. 3 is a cross-sectional side view of the handle grip piece of FIG. 2.
Figure 2:
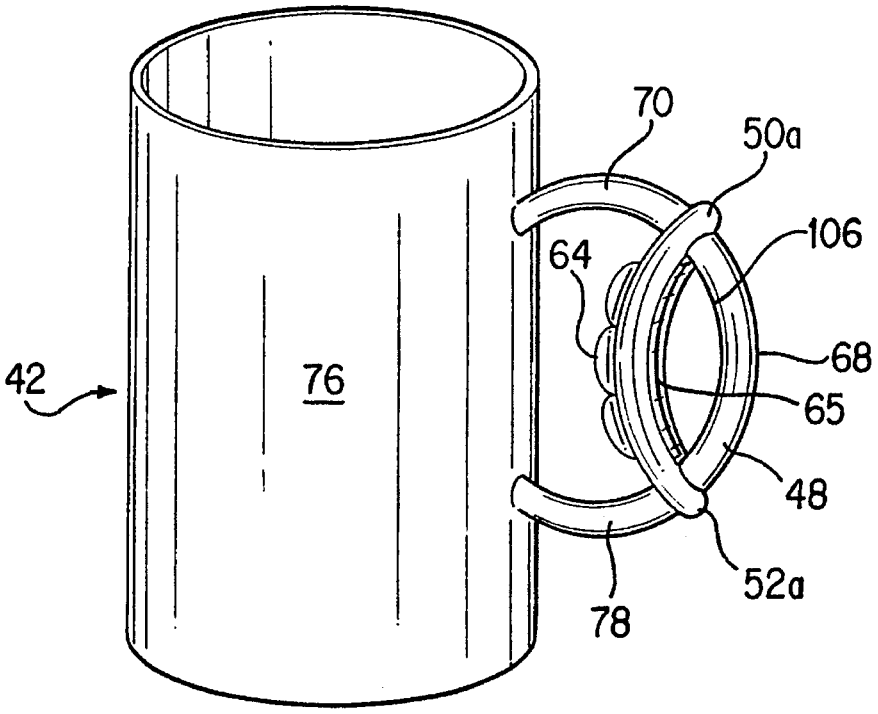
FIG. 2 is a perspective view of a handle grip piece according to a first preferred embodiment of the present invention shown in use with the handle of a conventional mug.

The handle grip piece 40 in accordance with a first preferred embodiment of the present invention is shown in FIGS. 2, 3 and 6 in use with a conventional mug 42. The handle grip piece 40 has two separate side pieces 44 and 46 that are adapted to be coupled or connected when deployed at the handle 8 of the mug 42. Each side piece 44 and 46 is preferably an arcuate or curved strip as shown in FIG. 3. Each side piece 44 and 46 has an upper extension 50*a* and 50*b*, respectively, and a lower extension 52*a* and 52*b*, respectively. Each side piece 44 and 46 further includes an upper recess 54*a* and 54*b*, respectively, and a lower recess 56*a* and 56*b*, respectively, provided along the inner edges 62*a* and 62*b*, respectively.

In addition, the two side pieces 44 and 46 include mechanisms for connecting the two side pieces 44 and 46 to form the unitary handle grip piece 40. In a first preferred embodiment illustrated in FIG. 6, the connecting mechanism has male protrusions 58 and female notches 60. Specifically, a plurality of male protrusions 58 are provided along the inner edge 62*a* of one side piece 44, and are adapted to be received in and engaged by a corresponding number of opposing female notches 60 provided along the inner edge 62*b* of the other side piece 46. The male protrusions 58 and female notches 60 can be provided along the inner edge of either side piece 44 and 46 without departing from the spirit and scope of the present invention, as long as the protrusions 58 and the notches 60 are provided at opposing edges. At least three sets of protrusions 58 and notches 60 are preferably provided in spaced-apart manner along the edges 62*a* and 62*b*, with one set provided at the upper extensions 50*a*, 50*b*, one set at the lower extensions 52*a*, 52*b*, and a third set provided between the recesses 54*a*, 54*b* and 56*a*, 56*b*. For example, in the embodiment of FIG. 6, three sets of protrusions 58 and notches 60 are provided between the recesses 54*a*, 54*b* and 56*a*, 56*b*. However, the number of sets of protrusions 58 and notches 60 is not critical, as any number of sets can be provided without departing from the spirit and scope of the present invention. Although sets of protrusions 58 and notches 60 have been described and illustrated, other alternative mechanisms can be used to connect the side pieces 44 and 46 without departing from the spirit and scope of the present invention. As a non-limiting example, opposing velcro pads can be provided on the side pieces 44 and 46 and used to connect the side pieces 44 and 46.

To deploy the handle grip piece 40, the user separates the two side pieces 44 and 46, and positions one side piece 44 to the left of the handle 48, and the other side piece 46 to the right of the handle 48 (see FIG. 6). The two sets of recesses 54*a*, 54*b* and 56*a*, 56*b* are adapted to receive sides of the two corresponding portions of the handle 48, as shown in FIGS. 2 and 6. Specifically, the upper recesses 54*a*, 54*b* receive a portion of the handle 48 between the central portion 68 and the top portion 70, and the lower recesses 56*a*, 56*b* receive a portion of the handle 48 between the central portion 68 and the bottom portion 78. Thus, the recesses 54*a*, 54*b* and 56*a*, 56*b* also function to attach or connect the handle grip piece 40 to the handle 48 when the side pieces 44 and 46 are connected together. The side pieces 44 and 46 are arcuate such that the outer surface 66 at their central portions 74 are closest to the wall 76 of the mug 42 and furthest from the central portion 68 of the handle 48, while the upper and lower extensions 50*a*, 50*b* and 52*a*, 52*b* are furthest from the wall 76 of the mug 42. Also, the inner surface 65 of the side pieces 44 and 46 at their central portions 74 are furthest from the central portion 68 of the handle 48.

The two side pieces 44 and 46 are then brought together about the handle 48 and connected together by engaging the male protrusions 58 into the female notches 60. After the two side pieces 44 and 46 have been connected, the handle grip piece 40 formed therefrom will assume the arcuate configuration shown in FIGS. 2 and 3, and the portions of the handle 48 will be secured within the recesses 54*a*, 54*b* and 56*a*, 56*b*. Bumps 64 are provided on the outer surface 66 of the side pieces 44 and 46 to enhance the grip for the user's fingers. The upper extensions 50*a* and 50*b* together act as a thumb rest. When so deployed, the inside of the user's fingers can be rested against the outer surface 66 of the side pieces 44 and 46, and the thumb rested against the upper extensions 50*a*, 50*b*, to provide a more secure and firmer grip. To remove the handle grip piece 40 for use with another mug, the user merely pulls the side pieces 44 and 46 apart, removes them from the handle 48, and deploys them at the handle of another mug.

The side pieces 44 and 46 are preferably made from a strip of hard rubber or plastic material, although other materials such as wood and bamboo, as non-limiting examples, can also be used without departing from the spirit and scope of the present invention. Such a material is preferably hard enough to allow the user's fingers to impart a force against the side pieces 44 and 46 without causing the side pieces 44 and 46 to buckle, yet has sufficient flexibility to allow the user to adjust the position of the handle grip piece 40 along the handle 48. For example, the user may wish to position the upper and lower extensions 50*a*, 50*b* and 52*a*, 52*b* closer to each other along the handle 48 to obtain a more arcuate configuration for the handle grip piece 40, or to position the upper and lower extensions 50*a*, 50*b* and 52*a*, 52*b* further from each other along the handle 48 to obtain a less arcuate configuration for the handle grip piece 40. The thickness of the side pieces 44 and 46 range from about 0.5 mm to 2.0 mm, and is preferably about 1.0 mm. The width W of each side piece 44 and 46 ranges from about 2.5 inches to 4.5 inches.

Figure 5:
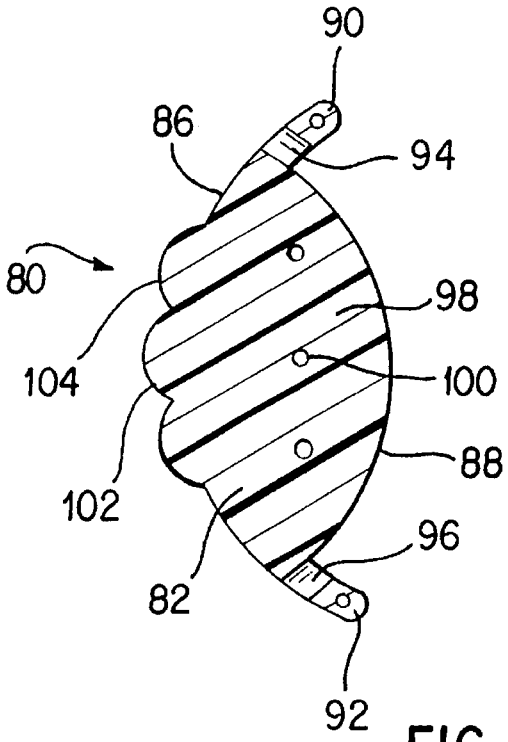
FIG. 5 is a cross-sectional side view of the handle grip piece of FIG. 4.
Figure 4:
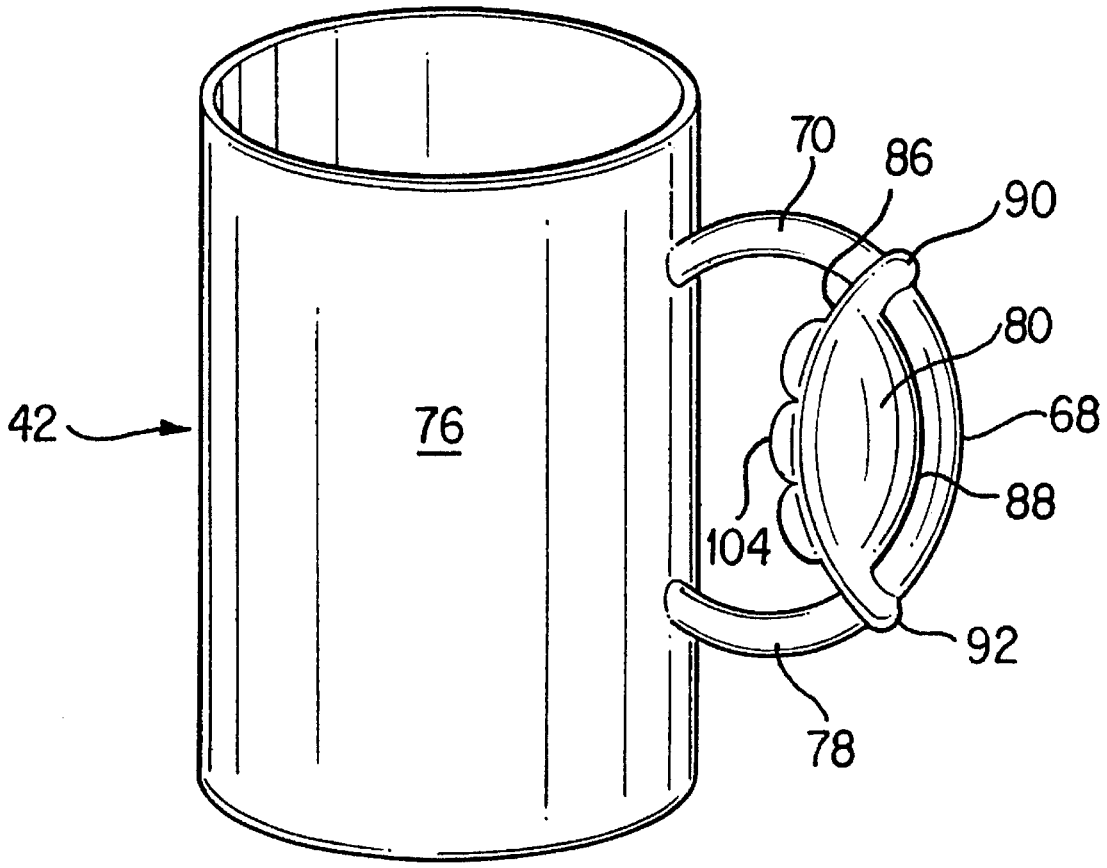
FIG. 4 is a perspective view of a handle grip piece according to a second preferred embodiment of the present invention shown in use with the handle of a conventional mug.

The handle grip piece 80 in accordance with a second preferred embodiment of the present invention is shown in FIGS. 4 and 5 in use with the conventional mug 42. The handle grip piece 80 is similar to the handle grip piece 40, and operates under similar principles, except it differs in that the thickness of the handle grip piece 80 is greater than the thickness of the handle grip piece 40. The exploded sectional side view of FIG. 6 would be the same for both the handle grip piece 40 and the handle grip piece 80, except that the numeral designations for the elements of the handle grip piece 80 would be different.

In particular, the handle grip piece 80 likewise has two separate side pieces that are adapted to be coupled or connected when deployed at the handle 48 of the mug 42. The cross-sectional view of one piece 82 is illustrated in FIG. 5. Each side piece 82 has a tear-drop shape configuration, with an arcuate outer surface 86 and an arcuate inner surface 88. Each side piece 82 also includes an upper extension 90 and a lower extension 92 similar to the extensions 50*a*, 50*b* and 52*a*, 52*b*. Thus, the side pieces 82 are configured so that their central portions 68 are wider than the extensions 90, 92. Each side piece 82 further includes an upper curved recess 94 and a lower curved recess 96 provided along the inner edge 98 thereof.

The connecting mechanisms for the side pieces 82 are preferably the same as those described above for the side pieces 44 and 46, and as illustrated in FIG. 6. For example, male protrusions provided on the inner edge 98 of one side piece can be inserted into the corresponding female notches 100 provided on the inner edge 98 of the other side piece 82. Alternatively, opposing velcro pads (not shown), screws and glue, as non-limiting examples, can also be used to connect the side pieces 82.

The handle grip piece 80 is also deployed in a similar manner. The user separates the two side pieces, and positions one side piece to the left of the handle 48, and the other side piece 82 to the right of the handle 48. The two sets of recesses 94 and 96 are adapted to receive the two corresponding portions of the handle 48, as shown in FIGS. 4 and 6. Specifically, the upper curved recesses 94 receive a portion of the handle 48 between the central portion 68 and the top portion 70, and the lower curved recesses 96 receive a portion of the handle 48 between the central portion 68 and the bottom portion 78. The side pieces 82 are arcuate such that the central portions 102 of their outer surfaces 86 are closest to the wall 76 of the mug 42 and furthest from the central portion 68 of the handle 48, while the upper and lower extensions 90 and 92 are furthest from the wall 76 of the mug 42.

The two side pieces 82 are then brought together about the handle 48 and connected together by engaging the male protrusions into the female notches 100. When the side pieces 82 are connected, the portions of the handle 48 are secured within the recesses 94 and 96. The arcuate inner surface 88 is preferably shaped to correspond to the inner surface of the handle 48, so that a portion of the handle grip piece 80 may be positioned against the inner surface of the handle 48 after the two side pieces 82 have been connected (see FIG. 4). This prevents buckling of the handle grip piece 80 when the user grips the handle grip piece 80 firmly, since the inside surface of the handle 48 provides the necessary support against the force exerted by the user's grip. Bumps 104 are also provided on the outer surface 86 of the side pieces 82 to act as finger grips for the user's fingers. The upper extensions 90 together act as a thumb rest. When so deployed, the inside of the user's fingers can be rested against the outer surface 86 of the side pieces 82, and the thumb rested against the upper extensions 90 to provide a more secure and firmer grip. To remove the handle grip piece 80 for use with another mug, the user merely pulls the side pieces 82 apart, removes them from the handle 48, and deploys them at the handle of another mug.

The side pieces 82 are preferably made from hard rubber or plastic, although wood and bamboo can also be used without departing from the spirit and scope of the present invention. The thickness of the central portion 102 of the side pieces 82 range from about 0.5 inches to 1.0 inches. The width W of each side piece 82 ranges from about 0.5 inches to 0.75 inches.

Thus, the handle grip pieces 40 and 80 according to the present invention provide a simple and effective device for improving the user's grip of the handle of a mug. The handle grip pieces 40 and 80 are easy to use, and can be deployed at the handle of any mug. Because of their simple design and construction, the handle grip pieces 40 and 80 are also easy and inexpensive to manufacture, so that they can be provided at low cost to the public. The removable handle grip piece 40 or 80 also allows the user the flexibility of removing the handle grip piece 40 or 80 if the user feels that it would be aesthetically unpleasing, or of keeping it in place at the handle if the user desires to have the improved grip.

Figure 1:
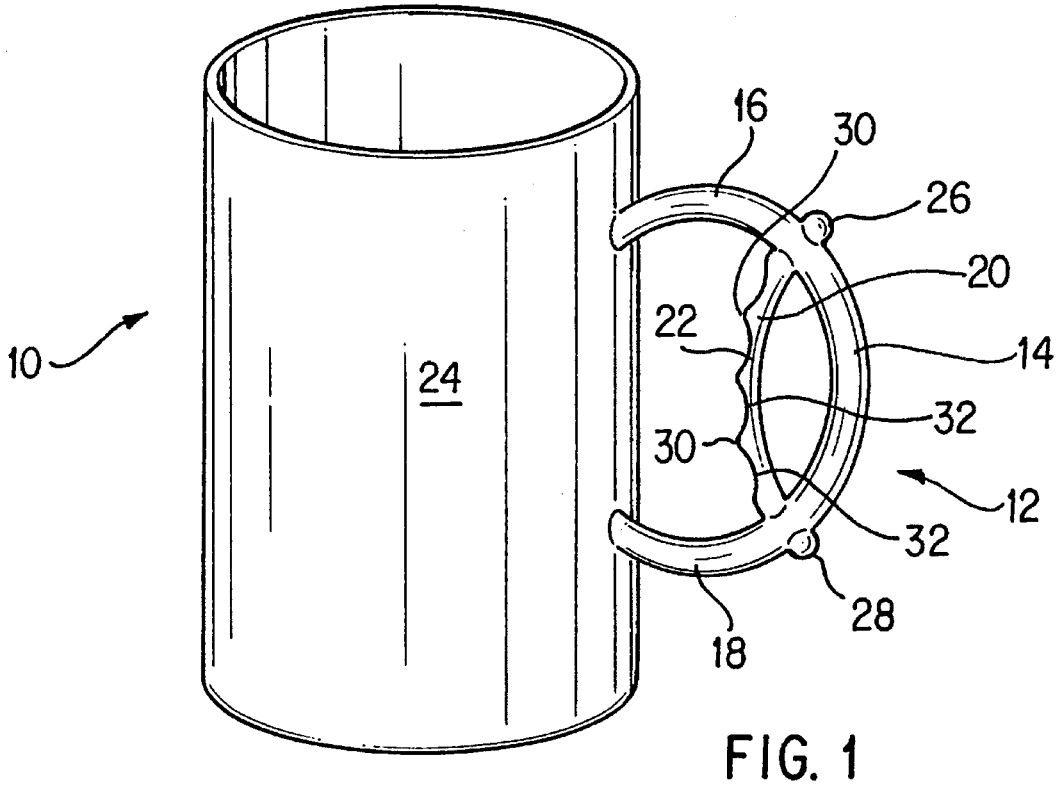
FIG. 1 PRIOR ART
FIG. 1 is a perspective view of a prior art drinking mug having a curved handle with a gripping bar provided thereon.

Although the present invention has been described in connection with the preferred embodiments, it will be appreciated by those skilled in the art that modifications can be made and alternatives utilized without departing from the spirit and scope of the present invention. For example, the configuration and size of the mug 42 is not critical. As a further non-limiting example, the shape of the side pieces 44, 46, 82 are not critical, although they must be sized and configured to fit the handle of the intended mug. As yet another non-limiting example, other mechanisms such as screwing or glue can be used to attach or secure the handle grip piece 40 or 80 to the handle. Another non-limiting example is that raised ridges and concave regions, such as those shown in FIG. 1, can be provided instead of the bumps 64 and 104.

What is claimed is:

1. A combination comprising:

a) a mug having a wall and a handle, the handle having a top portion connected to the wall, a bottom portion connected to the wall, and a central portion connected to the top and bottom portions, the top, central and bottom portions of the handle together with the wall defining a space between the handle and the wall; and b) a handle grip piece comprising:

(i) a first side piece comprising an inner edge and an outer surface facing the wall of the mug, the first side piece comprising an upper recess and a lower recess spaced-apart from each other along the inner edge;

(ii) a second side piece comprising an inner edge and an outer surface facing the wall of the mug, the second side piece comprising an upper recess and a lower recess spaced-apart from each other along the inner edge; and (iii) means positioned along the inner edges of the first and second side pieces for connecting the first side piece to the second side piece;

c) wherein the first and second side pieces are positioned substantially inside the space between the handle and the mug, the upper and lower recesses of the first and second side pieces retain and connect portions of the handle, and the handle is exposed and is not encapsulated by the first and second side pieces except by the upper and lower recesses of the first and second side pieces, when the first and second pieces are positioned inside the space between the handle and the mug.

2. The combination of claim 1, wherein the first and second side pieces each comprises a central portion, wherein the outer surfaces of the first and second pieces are arcuate, and wherein the central portions of the arcuate first and second side pieces are closer to the wall of the mug than the other portions of the arcuate first and second side pieces.

3. The combination of claim 1, wherein the means for connecting the first side piece to the second side piece comprises a plurality of protrusions extending from the inner edge of the first side piece, and a plurality of notches provided along the inner edge of the second side piece, wherein the protrusions of the first side piece are engaged with the notches of the second side piece to connect the first side piece to the second side piece.

4. The combination of claim 1, wherein the upper recesses of the first and second side pieces receive and connect the handle at a first location between the central portion and the top portion of the handle, and the lower recesses of the first and second side pieces receive and connect the handle at a second location between the central portion and the bottom portion of the handle.

5. The combination of claim 2, further comprising a plurality of bumps positioned on the arcuate outer surface of the first and second side pieces.

6. The combination of claim 1, wherein the inside of a user's fingers rest against the outer surfaces of the first and second side pieces when the first and second pieces are positioned inside the space between the handle and the mug.

7. The combination of claim 1, wherein the first and second side pieces each comprises a thin strip of material.

8. The combination of claim 1, wherein the first and second side pieces are spaced apart from the handle when the first and second pieces are positioned inside the space between the handle and the mug.

9. The combination of claim 1, wherein the handle of the mug has a curved inner surface, and wherein the first and second side pieces each further comprises an inner arcuate surface opposite the outer surface, the inner arcuate surface positioned adjacent the curved inner surface of the handle.

10. The combination of claim 2, wherein each of the first and second side pieces further comprises a thumb rest adjacent the upper recess.

11. The combination of claim 10, wherein each of the first and second side pieces further comprises an extension adjacent the lower recess.

* * * * *